US005489043A

United States Patent [19]

Newman

[11] Patent Number: 5,489,043

[45] Date of Patent: Feb. 6, 1996

[54] REMOVABLE BASE APPARATUS WITH STORAGE COMPARTMENT FOR WATER PIPE SMOKING DEVICES

[76] Inventor: Mark R. Newman, P.O. Box 17009, Tucson, Ariz. 85731

[21] Appl. No.: 116,999

[22] Filed: Sep. 7, 1993

[51] Int. Cl.[6] ..... A24F 1/14; A24F 1/30; B65D 25/00

[52] U.S. Cl. ..... 220/737; 220/603; 220/625; 220/630; 220/636; 131/173; 248/910

[58] Field of Search ..... 220/603, 625, 220/630, 636, 737; 131/173, 236; 248/910

[56] References Cited

U.S. PATENT DOCUMENTS

| | | | |
|---|---|---|---|
| D. 265,595 | 7/1982 | Galanter | D27/3 |
| 2,142,647 | 1/1939 | Heller | 220/603 |
| 2,191,434 | 2/1940 | Adler | 220/625 |
| 3,028,702 | 4/1962 | St. Cyr | 220/630 |
| 3,119,588 | 1/1964 | Keats | 248/910 |
| 3,624,788 | 11/1971 | McMahon | 220/737 |
| 3,831,209 | 8/1974 | Clingman | 220/630 |
| 4,031,904 | 6/1977 | Karl | 131/173 |
| 4,044,781 | 8/1977 | Heggestuen | 131/173 |
| 4,108,152 | 8/1978 | Kahler | 131/173 |
| 4,170,237 | 10/1979 | Epstein | 131/173 |
| 4,187,885 | 2/1980 | Kahler | 138/89 |
| 4,201,230 | 5/1980 | Howell, Jr. | 131/173 |
| 4,244,383 | 1/1981 | Kahler | 131/180 |
| 4,257,432 | 3/1981 | Griffith et al. | 131/173 |
| 4,325,390 | 4/1982 | Kahler | 131/173 |
| 4,666,324 | 5/1987 | Oses | 220/603 |
| 4,756,497 | 7/1988 | Lan | 220/630 |
| 4,771,911 | 9/1988 | Moroney et al. | 220/737 |
| 4,964,600 | 10/1990 | Lee | 248/910 |
| 5,186,350 | 2/1993 | McBride | 220/636 |
| 5,310,072 | 5/1994 | Matusovsky et al. | 220/737 |

*Primary Examiner*—David Scherbel
*Assistant Examiner*—Tony G. Soohoo
*Attorney, Agent, or Firm*—Victor Flores

[57] ABSTRACT

A cylindrical weighted base member for water pipe smoking devices. The weighted base structure is adapted to accommodate an insert member which is designed to detachably retain a tubular vessel member of a pipe smoking device. The insert member is surrounded by a weighted mass, such as cement or similar heavy substance. The insert member facilitates removal of the vessel member to allow the user to better access the lower interior of the tubular vessel member for cleaning purposes. The insert member includes a bottom portion which retains a flexible cup that also provides the primary structure for removably retaining the tubular vessel member. A variation of the weighted base member provides structure that is formed into a storage compartment for storing articles such as a smoking substance.

7 Claims, 4 Drawing Sheets

REMOVABLE BASE APPARATUS WITH STORAGE COMPARTMENT FOR WATER PIPE SMOKING DEVICES

FIELD OF THE INVENTION

The present invention relates to pipe smoking devices. More particularly, the present invention relates to base support members for the tubular body member of water pipe smoking devices. Even more particularly, the present invention pertains to pipe apparatus having storage compartments.

BACKGROUND OF THE INVENTION

A water pipe smoking apparatus to which the present invention pertains include those pipe apparatus which do not provide a storage compartment, those pipe apparatus having a cylindrical, weighted base member onto which an elongated cylindrical vessel body is fixedly attached, and those pipe apparatus which have a detachable vessel body, but do not have a weighted base for apparatus upright stability. Typically, the cylindrical vessel body includes a mid-length entry port for attachment of a stem member which comprises the bowl for the smoking substance. The elongated vessel body contains water which filters the smoking substance. In pipe apparatus having a fixedly attached base structure, the cleaning task after use is a drawback from a consumer point of view. Representative of this type of pipe apparatus, is an embodiment with the ornamental aspects of the pipe apparatus depicted in U.S. Pat. No. Des. 265,595. Representative of those pipe apparatus which have a detachable vessel body, but do not have a weighted base for apparatus upright stability, are embodiments taught by U.S. Pat. No. 4,187,885 which teaches a removable sealing device for a water pipe body, U.S. Pat. No. 4,844,383 which teaches a water pipe body removable from a chamber and retained using rubber pieces around the vessel body, U.S. Pat. No. 4,325,390 which teaches a gibbous-like base reservoir that weights and stabilizes the pipe device with a low center of gravity, U.S. Pat. No. 4,170,237 which teaches a removable lower cap that allows access to the lower end of tube 12 for cleaning, U.S. Pat. No. 4,201,230 which teaches a neoprene plug that expands or contracts as required to facilitate removal of the water pipe body, U.S. Pat. No. 4,044,781 which teaches a cap removable from the bottom end of the tube body using a threaded means. U.S. Pat. No. 4,257,432 is of interest for teaching a filter section attached to a base container that is weighted by water and which appears to be removable from the filter section. U.S. Pat. No. 4,108,152 is also of interest for teaching a storage compartment at the upper mouth end of the pipe device.

While the prior art has addressed the pipe apparatus cleaning problem associated with having a fixed vessel member as part of the pipe apparatus, the solutions have not been widely accepted for reasons associated with high cost to produce and with inadequate structure to effect the cleaning task. Also, the need for a storage compartment persist because the locations taught and implemented by the prior art pipe apparatus devices are deemed impractical.

Thus, a need is seen to exist for a weighted base structure which facilitates removal of a tubular vessel member of a pipe apparatus and which provides an optional storage compartment at the bottom end of the weighted base structure.

SUMMARY OF THE INVENTION

Accordingly, the primary object of the present invention is to provide a weighted base structure for use with liquid pipe smoking apparatus which facilitates removal of a tubular liquid containing vessel member of the pipe apparatus.

Another object of the present invention is to provide a storage compartment located on the bottom end of a weighted base member of a liquid pipe smoking apparatus.

A more particular object of the present invention is to provide a weighted base structure for use with liquid pipe smoking apparatus which not only facilitates removal of a tubular liquid containing vessel member of the pipe apparatus, but that also provides a storage compartment located on the bottom end of the weighted base member.

A related object of the present invention is to provide a pipe smoking apparatus having any or all of the foregoing objects.

The foregoing objects are accomplished by providing a base member of a liquid pipe smoking apparatus having the form of a cylindrical base that is adapted to accommodate an insert which is designed to detachably retain a tubular vessel member of the pipe smoking apparatus. The insert member is surrounded by a weighted mass, such as cement, or similar substance. The insert facilitates removal of the vessel body to allow the user to better access the lower interior of the vessel body for cleaning purposes. The insert member comprises an insert structure portion having a bottom portion which accommodates a flexible cup that primarily receives and retains the tubular vessel body. The inserted portion of the vessel body expands the flexible cup such that the upper circular rim of the cup will contact a circumferential ridge on the wall of the insert portion upon being pulled upward. Thus, in removing the tubular vessel body, the first tug causes the tight-fitting tubular vessel in the flexible cup to rise upward and stop at the circumferential ridge. For removal of the tubular vessel body from the base, a slightly greater tug is needed to release the tubular vessel body from the tight fitted retained state within the flexible cup. In a variation of the weighted base member, the exterior cylindrical shell of the base is extended downward to provide structure that is formed into a storage compartment for storing articles such as smoking substance. The storage compartment extends from the weighted mass in the base and is formed to be covered with a threaded or friction retained bottom cap member.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating the preferred embodiment in which the invention may be practiced.

DESCRIPTION OF THE PREFERRED EMBODIMENT

Figure 1:
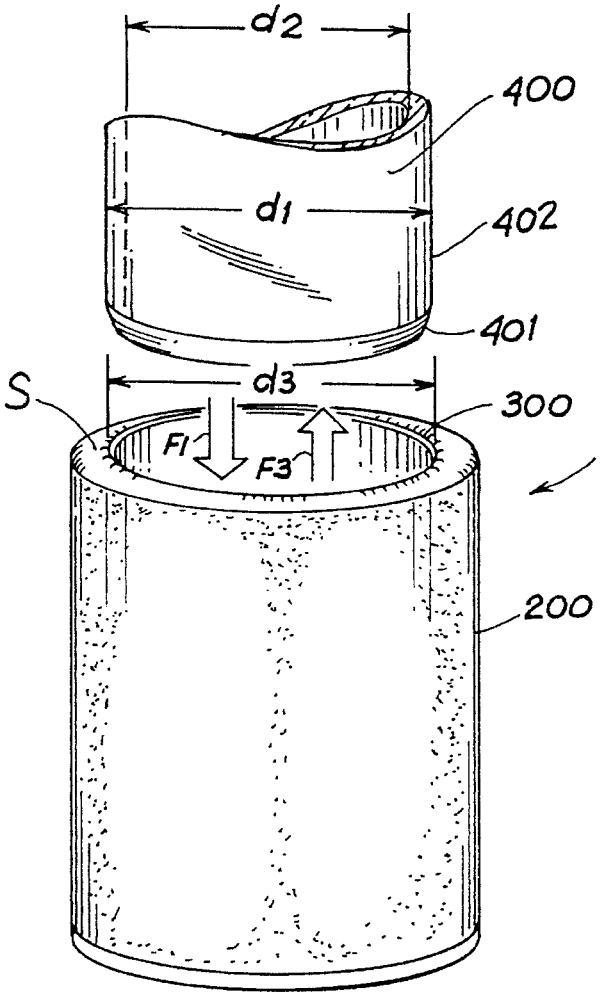
FIG. 1 is a view of the present invention illustrated with a beveled lower end portion of a tubular vessel body, such as those used in a liquid (water or other suitable liquid) pipe smoking apparatus, shown in a removed state from the weighted base member in accordance with the present invention.
Figure 8:
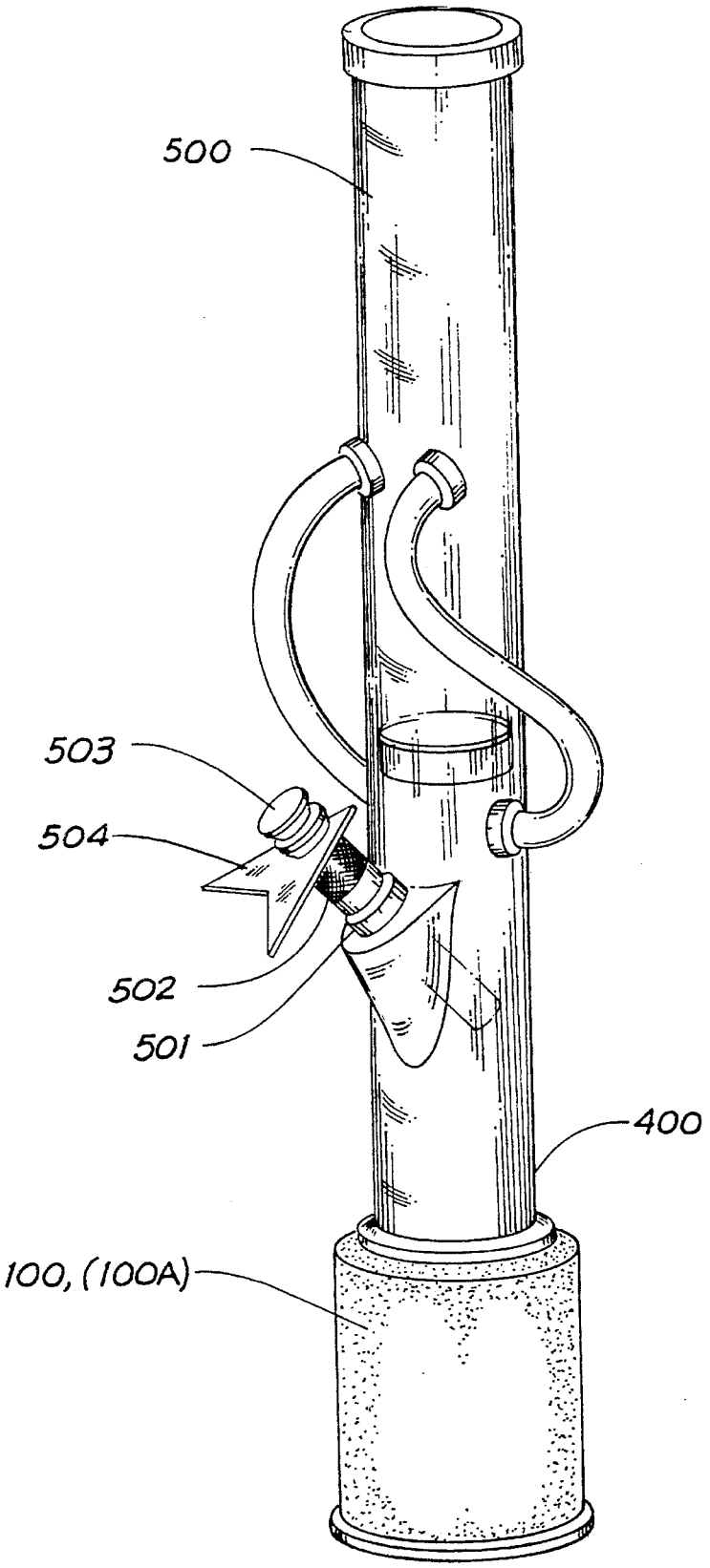
FIG. 8 shows a pipe smoking device with a base in accordance with the present invention.

As discussed earlier, the elongated cylindrical vessel body of a water pipe smoking apparatus includes a mid-length entry port for attachment of a stem member, see FIG. 8 generally, which comprises the bowl for the smoking substance. The elongated vessel body contains the liquid which filters the smoking substance. FIG. 1 illustrates a lower end portion of a tubular vessel body 400. The vessel 400 is open at the lower end and is provided with a beveled bottom lip 401 to encourage easy insertion, as indicated by arrow F1, into insert member 300 of the weighted base assembly 100. Insert member 300 comprises of an insert structure 301 and a flexible cup 320. The outer diameter of vessel wall 402 is designated as d1 and the lesser beveled diameter is designated as d2. The diameter d3 of insert structure 301 is greater than d1 such that a clearance of at least 0.005 inches is maintained. As will be described below, the insert structure 301 not only facilitates insertion, or engagement, of vessel 400 into insert 301 as indicated by arrow F1, the structure also facilities disengagement of the vessel 400 from insert 301 as indicated by arrow F3.

Figure 2:
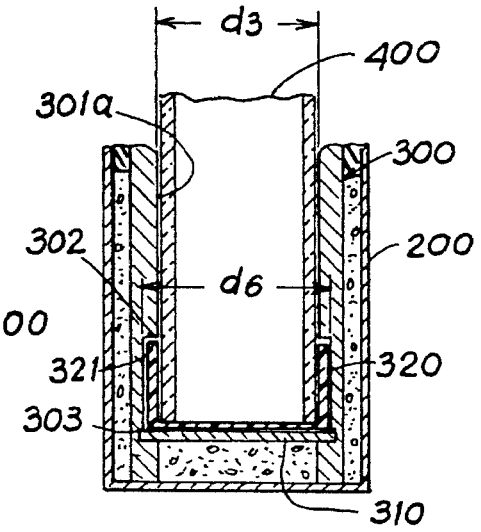
FIG. 2 illustrates in cross section a lower end portion of a tubular vessel body in an inserted state within the insert member and the lower end flexible retainer cup.
Figure 4:
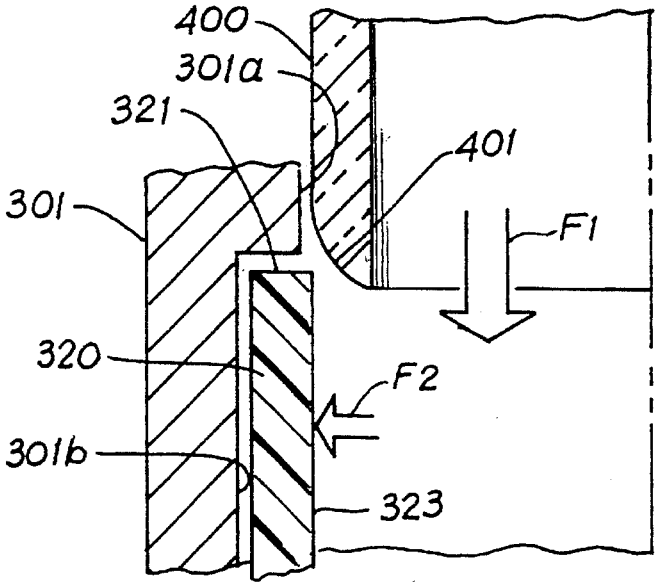
FIG. 4 illustrates an enlarged view of the upper end of the flexible cup and the force diagram associated with inserting the tubular vessel body into the cup, including the circumferential ridge that stops the cup from being withdrawn during removal of the tubular vessel.
Figure 5:
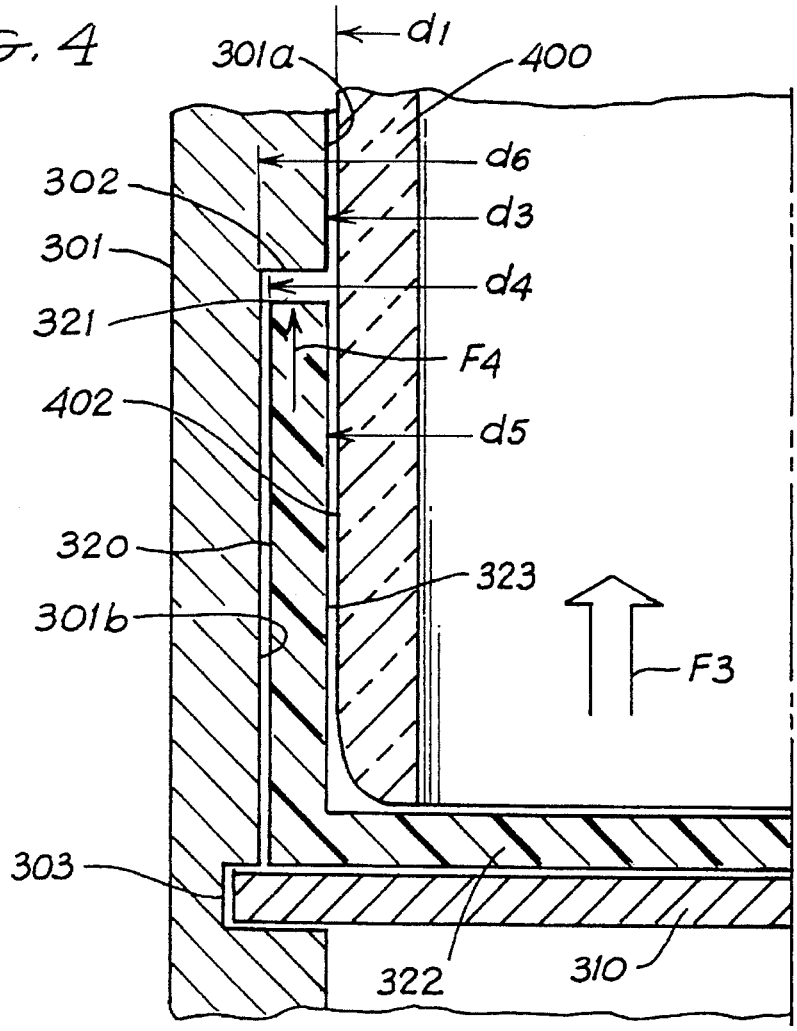
FIG. 5 illustrates an enlarged view of the bottom end of the base insert with the flexible cup and the inserted tubular vessel.
Figure 6:
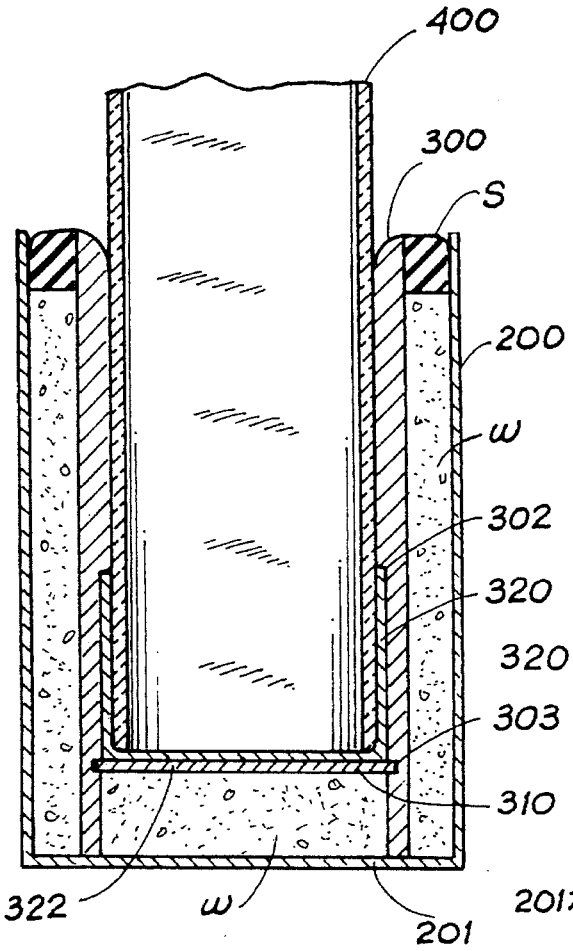
FIG. 6 illustrates in cross section the weighted base structure showing the weighted mass sealed at an upper end and at a lower end between the insert member and the outer base shell member.

As best seen in FIGS. 2 and 6, insert member 300 is surrounded by a weighted mass W, which is preferably a hardenable cement that, in an initial liquid state, will flow and conform to the space between insert member 300 and the outer shell member 200, including a bottom end 201, for sealing with a suitable epoxy or similar sealant S. The structure of insert 301 provides a bottommost circumferential groove 303 for placement of a bottom cap member 310. Bottom member 310 not only provides a seal to stop the flow of cement during assembly of base 100, but also serves as a smooth bottom surface for bottom 322 of flexible cup 320 which is placed at the bottom of insert 301. Bottom member 310 is kept within groove 303 and is made of a flexible plastic material to allow deformation to allow being fitted in groove 303, where it will reform back to its original shape. The structure of insert 301 is formed, by example, from aluminum, with upper wall portion 301*a*, see FIG. 2 and FIG. 5, which has a diameter d3, previously discussed, and with a lower adjoining portion 301*b*, see generally FIGS. 4 and 5, which has a diameter d6 that is greater than diameter d4 of cup 320, see FIG. 3. The junction where the diameter d6 is formed creates a circumferential ridge 302 which retains cup 320, see FIGS. 2 and 6.

Figure 3:
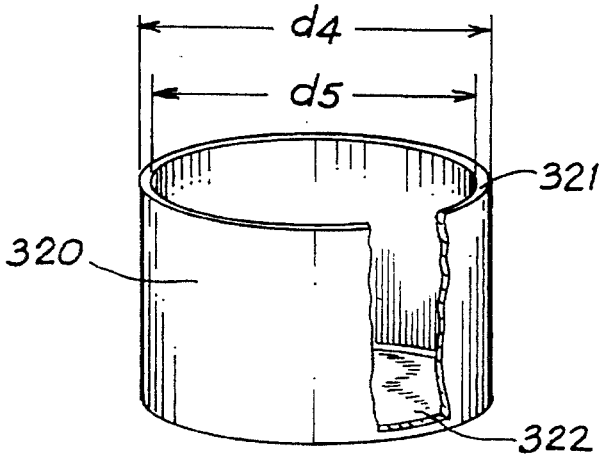
FIG. 3 illustrates a partial cutaway view of the flexible retainer cup.

As seen in FIG. 3, cup 320 has a rim 321 and a bottom 322. The inside diameter d5 of flexible cup 320 is less than diameter d1 of vessel 400, but is greater than diameter d2 of the beveled end 401. The diameter d4 is variable due to the flexible wall structure of cup 320. Thus, as best seen from FIG. 4, upon inserting vessel 400 beyond upper insert portion 301*a*, the lesser diameter of beveled end 401 engages easily into cup 320. The outer wall of vessel 400 contact the inner wall 323 of cup 320 to exert an outward force F2 to cause outward deformation of cup 320 toward the wall of lower portion 301*b*. The continued application of force F1 results in the inner wall 323 of cup 320 to be in a removable contact relationship with outer wall 402 of vessel 400. The material used to make cup 320 is a plastic material that is compatible with the material of vessel 400, which is typically a translucent acrylic material, such that the contact relationship allows a slipping engagement and disengagement of vessel 400. The expanded walls of cup 320 effectively cause rim 321 to be in an aligned position with ridge 302, see FIG. 5. Thus, since the wall 402 of vessel 400 are firmly contacting wall 323 the upward force F3 will tend to carry the flexible cup upward as indicated by arrow F4 until rim 321 contacts ridge 302 to stop the upward motion of the firmly held cup and vessel. Once rim 321 contacts ridge 302 and stops the motion of cup 320 the wall contact relationship becomes a slipping contact relationship such that the vessel continues the upward motion until complete removal from insert 301 is effected.

Figure 7:
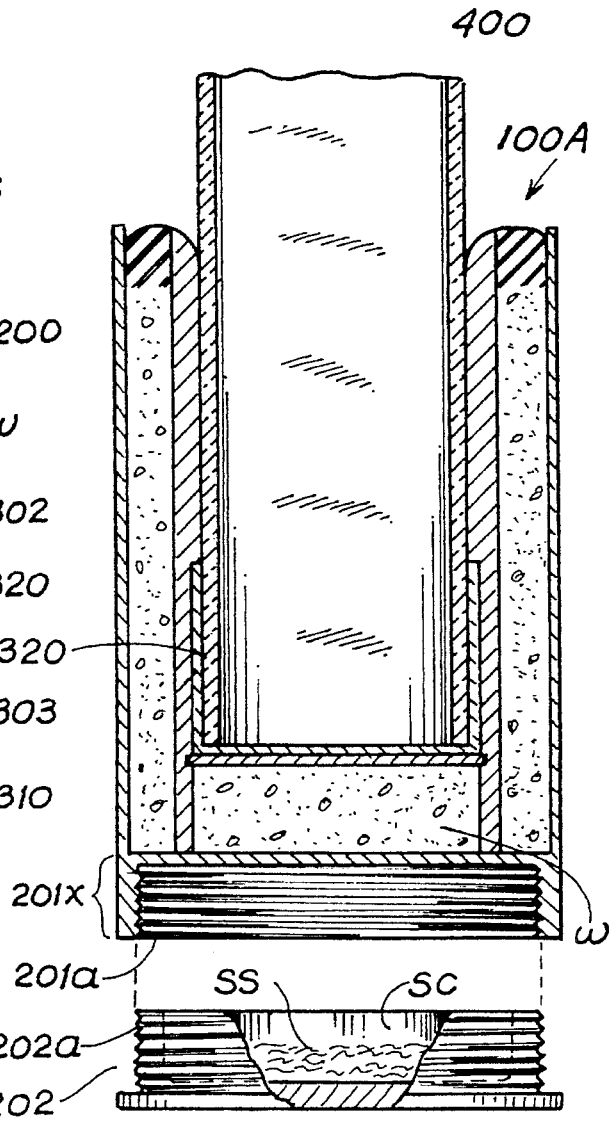
FIG. 7 shows a weighted base embodiment with the outer shell member having a bottom extension structure that forms a storage compartment.

FIG. 7 shows a modified weighted base embodiment 100A having the outer shell member 200A adapted with a bottom extension structure 201X that forms a storage compartment SC for storing articles such as a smoking substance SS. The storage compartment extends from the weighted mass in the base and, by example, is formed to be covered with a bottom cap member 202 threadedly secured by threads 201*a*, 202*a*.

FIG. 8 shows a pipe smoking device 500 adapted to fit either removable base member 100 or 100A. Device 500 is provide with a protruding side port 501 for stem 502 and bowl 503. Stem 502 being held by a holder 504.

Therefore, while the present invention has been shown and described herein in what is believed to be the most practical and preferred embodiment, it is recognized that departures can be made therefrom within the scope of the invention, which scope is therefore not to be limited to the details disclosed herein but is to be accorded the full scope of the claims so as to embrace any and all equivalent apparatus.

I claim:

1. A base apparatus for supporting a water pipe smoking device, said device including an elongated, cylindrical body member having a first diameter, said apparatus comprising:

an outer base structure;

an insert structure disposed within said outer base structure, said insert structure comprising a first cylindrical portion and a second cylindrical portion, said second cylindrical portion having an associated diameter that is greater than a diameter associated with said first cylindrical portion, said first and second cylindrical portions forming a junction that delineates a stop ridge;

weighted material dispersed between said outer base structure and said insert structure; and a retainer cup for detachably mounting said cylindrical body member, said retainer cup being a cylindrically formed structure having a flexible wall structure and an upper rim defining an opening for said cup, said upper rim having an outer diameter that is greater than said diameter associated with said first cylindrical portion and an inner diameter that is less than said first diameter of said water pipe body member, said flexible wall structure facilitating said cup being disposed within said second cylindrical portion and being retained there by said stop ridge, said flexible wall structure being expandable for facilitating a forced engagement and disengagement of said water pipe body member and for effecting a greater retention of said cup within said second cylindrical portion.

2. A base apparatus for supporting a water pipe smoking device as recited in claim 1, further comprising:

a bottom end member for said insert structure, said bottom end member being formed from a flexible material; and said insert structure further comprises a third cylindrical portion defining a bottom end circumferential groove having an associated diameter that is greater than said diameter associated with said second cylindrical portion, said bottom end member having an associated diameter that is greater than said diameter associated with said second cylindrical portion and being deformable for being fitted and retained within said groove, said bottom end member providing a bottom support for said cup and providing a partition for a bottom portion of said weighted material.

3. A base apparatus for supporting a water pipe smoking device as recited in claim 2, further comprising:

said outer base structure being adapted with a bottom extension structure extending from a bottom end of said outer base structure, said bottom extension forming a storage compartment, said storage compartment being covered with a removable cap member.

4. A base apparatus for supporting a water pipe smoking device as recited in claim 1, further comprising:

a bottom extension structure extending from a bottom end of said outer base structure, said bottom extension forming a storage compartment, said storage compartment being covered with a removable cap member.

5. A base apparatus for supporting a water pipe smoking device, said device including an elongated, cylindrical body member having a first diameter, said apparatus comprising:

an outer base structure;

an insert structure disposed within said outer base structure, said insert structure comprising a first cylindrical portion, a second cylindrical portion and a third cylindrial portion, said second cylindrical portion having an associated diameter that is greater than a diameter associated with said first cylindrical portion, said first and second cylindrical portions forming a junction that delineates a stop ridge, said third cylindrical portion defining a bottom end circumferential groove having an associated diameter that is greater than said diameter associated with said second cylindrical portion;

a bottom end member for said insert structure, said bottom end member being formed from a flexible material, said bottom end member having an associated diameter that is greater than said diameter associated with said second cylindrical portion and being deformable for being fitted and retained within said groove;

weighted material dispersed between said outer base structure and said insert structure;

a retainer cup detachably mounting said water pipe body member, said retainer cup being a cylindrically formed structure having a flexible wall structure and an upper rim defining an opening for said cup, said upper rim having an outer diameter that is greater than said diameter associated with said first cylindrical portion and an inner diameter that is less than said first diameter of said water pipe body member, said flexible wall structure facilitating said cup being disposed within said second cylindrical portion and retained there by said stop ridge, said flexible wall structure being expandable for facilitating a forced engagement and disengagement of said water pipe body member and for effecting a greater retention of said cup within said second cylindrical portion, said bottom end member providing a bottom support for said cup and also providing a partition for a bottom portion of said weighted material; and a bottom extension structure extending from a bottom end of said outer base structure, said bottom extension structure forming a storage compartment, said storage compartment being covered with a removable cap member.

6. A water pipe smoking apparatus, said apparatus comprising:

an elongated cylindrical vessel body member having a first diameter, an entry port protruding from a side of said vessel, a stem member attached to said port, said stem comprising a bowl for containing smoking substance; and a detachable weighted base structure, said base structure comprising:

an outer base structure;

an insert structure disposed within said outer base structure, said insert structure comprising a first cylindrical portion, a second cylindrical portion and a third cylindrical portion, said second cylindrical portion having an associated diameter that is greater than a diameter associated with said first cylindrical portion, said first and second cylindrical portions forming a junction that delineates a stop ridge, said third cylindrical portion defining a bottom end circumferential groove having an associated diameter that is greater than said diameter associated with said second cylindrical portion;

a bottom end member for said insert structure, said bottom end member being formed from a flexible material, said bottom end member having an associated diameter that is greater than said diameter associated with said second cylindrical portion and being deformable for being fitted and retained within said groove;

weighted material dispersed between said outer base structure and said insert structure; and a retainer cup for detachably mounting said cylindrical vessel body member, said retainer cup being a cylindrically formed structure having a flexible wall structure and an upper rim defining an opening for said cup, said upper rim having an outer diameter that is greater than said diameter associated with said first cylindrical portion and an inner diameter that is less than said first diameter of said cylindrical vessel body member, said flexible wall structure facilitating said cup being disposed within said second cylindrical portion and being retained there by said stop ridge, said flexible wall structure being expandable for facilitating a forced engagement and disengagement of said cylindrical vessel body member and for effecting a greater retention of said cup within said second cylindrical portion, said bottom end member providing a bottom support for said cup and also providing a partition for a bottom portion of said weighted material.

7. A pipe smoking apparatus as recited in claim 6, further comprising:

a bottom extension structure extending from a bottom end of said outer base structure, said bottom extension forming a storage compartment, said storage compartment being covered with a removable cap member.

* * * * *